US006923345B1

(12) United States Patent
Laible

(10) Patent No.: US 6,923,345 B1
(45) Date of Patent: Aug. 2, 2005

(54) DISPENSING SYSTEM

(76) Inventor: Rodney Laible, 16315 Pawnee Rd., Bennington, NE (US) 68007

( * ) Notice: Subject to any disclaimer, the term of this patent is extended or adjusted under 35 U.S.C. 154(b) by 64 days.

(21) Appl. No.: 10/685,549

(22) Filed: Oct. 15, 2003

Related U.S. Application Data

(63) Continuation-in-part of application No. 10/372,375, filed on Feb. 22, 2003, which is a continuation-in-part of application No. 10/074,469, filed on Feb. 12, 2002, now abandoned.

(51) Int. Cl.[7] ..... B67D 5/06
(52) U.S. Cl. ..... 222/185.1; 222/189.09; 222/481.5; 222/518
(58) Field of Search ..... 222/181.1, 185.1, 222/189.09, 481.5, 518

(56) References Cited

U.S. PATENT DOCUMENTS

| | | | | |
|---|---|---|---|---|
| 1,305,476 A | * | 6/1919 | McCord | 222/449 |
| 3,123,107 A | * | 3/1964 | Kappler | 141/352 |
| 4,401,272 A | | 8/1983 | Merton et al. | 239/337 |
| 5,048,723 A | | 9/1991 | Seymour | 222/81 |
| 5,154,212 A | * | 10/1992 | Weber | 141/353 |
| 5,350,091 A | | 9/1994 | Leete et al. | 222/529 |
| 5,368,025 A | | 11/1994 | Young et al. | 222/189.06 |
| 5,472,124 A | | 12/1995 | Martushev | 222/529 |
| 5,526,961 A | * | 6/1996 | Burrows | 222/185.1 |
| 5,706,985 A | * | 1/1998 | Feer | 222/185.1 |
| 5,988,456 A | | 11/1999 | Laible | 222/464.1 |
| 6,062,435 A | | 5/2000 | Hess, III | 222/175 |
| 6,131,774 A | * | 10/2000 | Thomas et al. | 222/181.2 |
| 6,155,464 A | * | 12/2000 | Vachon | 222/484 |
| 6,299,037 B1 | | 10/2001 | Lee | 222/518 |
| 6,648,180 B2 | * | 11/2003 | Moon et al. | 222/185.1 |

* cited by examiner

*Primary Examiner*—Joseph A. Kaufman
(74) *Attorney, Agent, or Firm*—Thomte, Mazour & Niebergall; Dennis L. Thomte

(57) ABSTRACT

A dispensing system for use on a liquid container such as a bottle or the like for dispensing the liquid contents from the bottle. The outlet opening of the container is closed by a throat plug assembly having a valve positioned therein which is open when the container is mounted in a dispensing fixture which is closed when the container is not mounted on the dispensing system. The throat plug assembly also includes a specifically shaped valve which is opened slightly when the container is being stored or transported to vent vapor pressure from within the container should the same be necessary.

23 Claims, 9 Drawing Sheets

DISPENSING SYSTEM

CROSS-REFERENCE TO RELATED APPLICATION

This is a continuation-in-part application of Petitioner's earlier application Ser. No. 10/372,375 filed Feb. 22, 2003, entitled CLOSED LOOP DISPENSING SYSTEM, which is a continuation-in-part application of Petitioner's earlier application Ser. No. 10/074,469 filed Feb. 12, 2002, now abandoned, entitled CLOSED LOOP DISPENSING SYSTEM WITH METERING ORIFICE.

BACKGROUND OF THE INVENTION

1. Field of the Invention

This invention relates to a dispensing system, which may be either an open loop or closed loop dispensing system, and more particularly to a dispensing system for dispensing corrosive liquid chemicals or dangerous medical liquid products which are typically drawn from the upper end of a container, such as a bottle or the like, to a mixing machine or the like. In the instant invention, the container is inverted with the liquid product gravity flowing from the lower end thereof. Further, the dispensing system of this invention provides a means for venting the container during shipment or storage in those situations where the liquid within the container requires venting.

2. Description of the Related Art

Corrosive liquid chemicals and dangerous medical liquid products are typically contained in a container such as a bottle or the like and are frequently dispensed therefrom to a mixing machine. Normally, a cap is placed on the bottle with a dip tube extending therefrom downwardly into the interior of the bottle for drawing the liquid upwardly thereinto. Normally, a dispensing tube extends from the cap to a mixing machine or some other piece of equipment which creates suction in the dispensing tube to draw the liquid from the interior of the bottle. In some prior art devices, when the suction or vacuum is removed from the dispensing tube, backflow may occur. Further, when the cap is removed from the bottle, backflow from the dispensing tube may also occur. Additionally, when the cap is removed from the bottle, liquid residue in the bottle may spill therefrom. Additionally, the conventional prior art systems normally do not prevent the re-use of the bottle which is prohibited in some cases. Yet another disadvantage of the prior art is that a reliable and efficient venting means for the bottle is not normally provided for relieving vacuum pressure from within the bottle. The system of co-pending application Ser. No. 10/372,375 solved the problems associated with the prior art devices or systems.

While the system of co-pending application Ser. No. 10/372,375 works extremely well when the container is in its normal upright condition, the system may not perfectly function when the container of the co-pending application is inverted. When the container or bottle of co-pending application Ser. No. 10/372,375 is inverted, the liquid in the container is drawn or discharged from the normal upper end of the container but which is the lower end of the container in the inverted position. In such a position, the venting membrane, which would normally permit ambient air to replace the liquid in the container as the liquid is discharged from the container, may become "clogged" due to the liquid coming into contact therewith and crystallizing thereon. If air is not permitted to enter the container as the liquid is drawn therefrom, a partial vacuum is created in the upper end of the inverted container which will interfere with the discharge of the liquid therefrom.

The system of co-pending application Ser. No. 10/372,375 solved the problems of the prior art and represented an improvement in the invention of co-pending application Ser. No. 10/074,469. The instant invention represents an improvement over the invention described in co-pending application Ser. No. 10/372,375.

SUMMARY OF THE INVENTION

This invention relates to a dispensing system for use with a container, such as a bottle or the like, having an outlet opening formed in the upper end thereof. A cap is removably mounted on the container for selectively closing the outlet opening during shipment and storage. In use, the container is positioned in an inverted position. The lower end of the inverted container has a hollow throat extending downwardly therefrom which has interior and exterior surfaces. A throat plug assembly, having upper and lower ends, is positioned in the throat of the container. The throat plug assembly includes a hollow cylindrical plug member having an open upper end, an open lower end, and a cylindrical wall portion extending therebetween. A tube support is positioned on the open upper end of the plug member. A hollow tube, having upper and lower ends, is secured to the tube support so that its lower end is positioned below the tube support within the plug member. The open lower end of the plug member defines a valve seat. A valve assembly or means is movably positioned within the plug member and includes a normally closed valve and a hollow valve stem extending upwardly therefrom. The hollow valve stem is slidably mounted on the hollow tube which is secured to the tube support. The valve is movable between open and closed positions. The valve, when in its closed position, seats upon the valve seat to close the open lower end of the plug member. A spring is provided in the plug member which is in engagement with the valve means to yieldably urge the valve to its closed position. The valve, when in its closed position, prevents liquid within the container from flowing therefrom. The valve, when in its open position, permits liquid within the container to flow therethrough. At least one of the tube support, cylindrical wall portion or valve stem has a passageway formed therein. The throat plug assembly, when the valve is in its open position, permits liquid in the container to flow therefrom through the passageway, around the valve and outwardly through the valve seat. The throat plug assembly, when the valve is in its open position, permits air to enter the container by passing through the valve seat, around the valve and through the passageway.

When the container contains liquids that require venting during storage or shipment, the throat plug assembly is designed in such a way so as to cooperate with the container cap so that the valve is slightly unseated so that pressure within the container may be vented through the throat plug assembly and through an opening formed in the cap. The valve permits vapor pressure to pass therethrough but prevents liquid from passing therethrough.

It is therefore a principal object of the invention to provide an improved dispensing system for corrosive or dangerous liquids contained in a container such as a bottle or the like, when the container is positioned in an inverted condition.

A further object of the invention is to provide a dispensing system which includes a throat plug positioned in the outlet opening of the container with the throat plug being designed so that it will permit vapor pressure within the container to be vented therethrough when the container is being stored or transported.

Still another object of the invention is to provide an improved dispensing system of the type described which permits sufficient air to enter the interior of the container to replace the liquid being dispensed therefrom so that vapor locks are prevented.

Still another object of the invention is to provide a dispensing system which is safe and convenient to use.

Yet another object of the invention is to provide a dispensing system which is reliable in use.

These and other objects will be obvious to those skilled in the art.

DETAILED DESCRIPTION OF THE INVENTION

Figure 1:
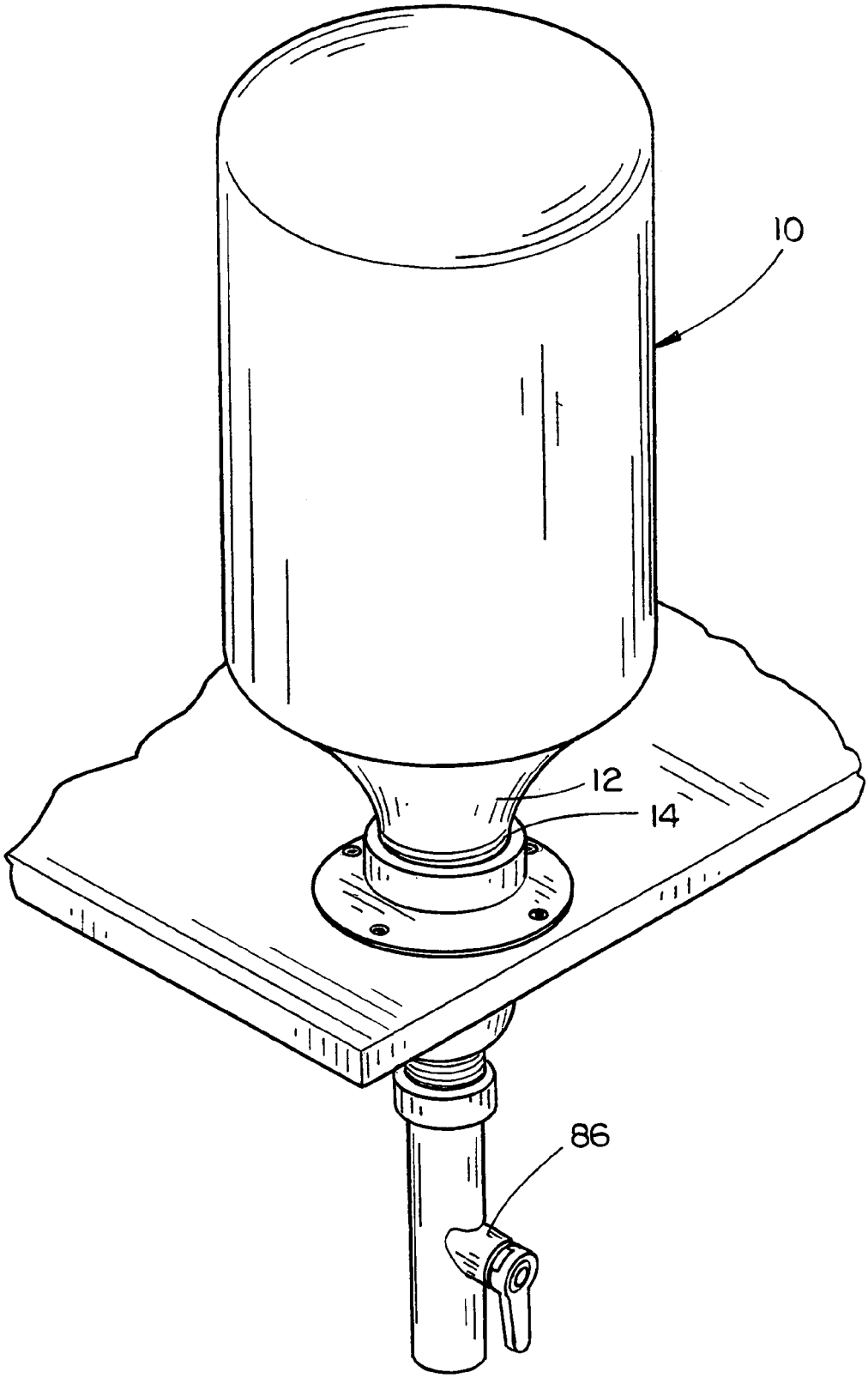
FIG. 1 is a perspective view of a container utilized with the instant invention with the container being in an inverted position so as to dispense liquids.
Figure 3:
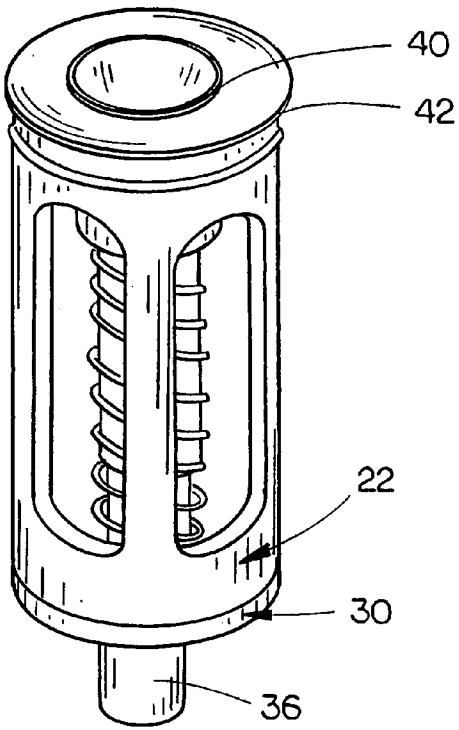
FIG. 3 is a perspective view of the throat plug assembly with the throat plug assembly being illustrated in the position when the container is in its upright condition.

In the drawings, the numeral 10 refers to a conventional container such as a bottle or the like which is used for transporting, storing and dispensing liquids therefrom. FIG. 1 illustrates the container 10 in an inverted dispensing position. Container 10 includes a hollow throat portion 12 extending downwardly therefrom and which has external threads 14 mounted thereon.

Figure 2:
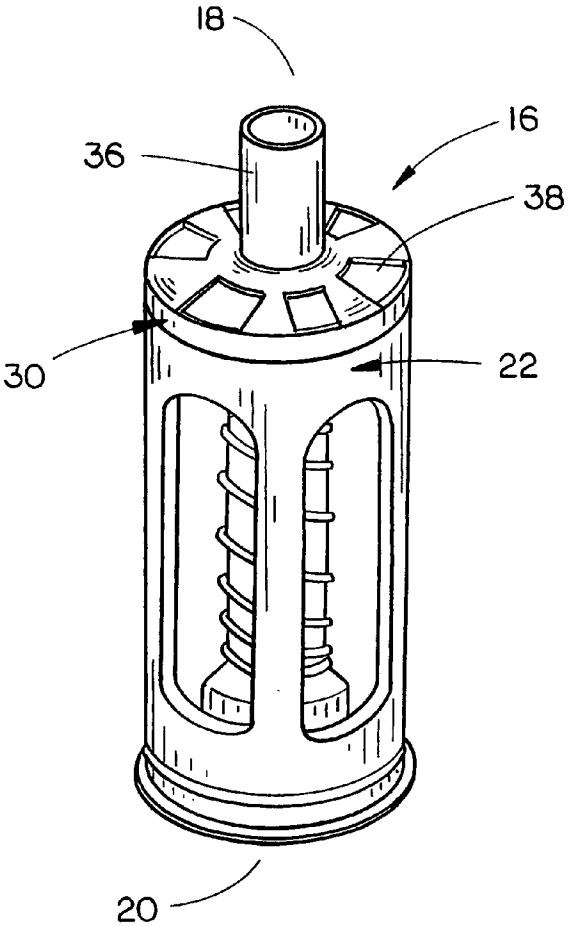
FIG. 2 is a perspective view of the throat plug assembly illustrating the throat plug in the position when the container is inverted.
Figure 4:
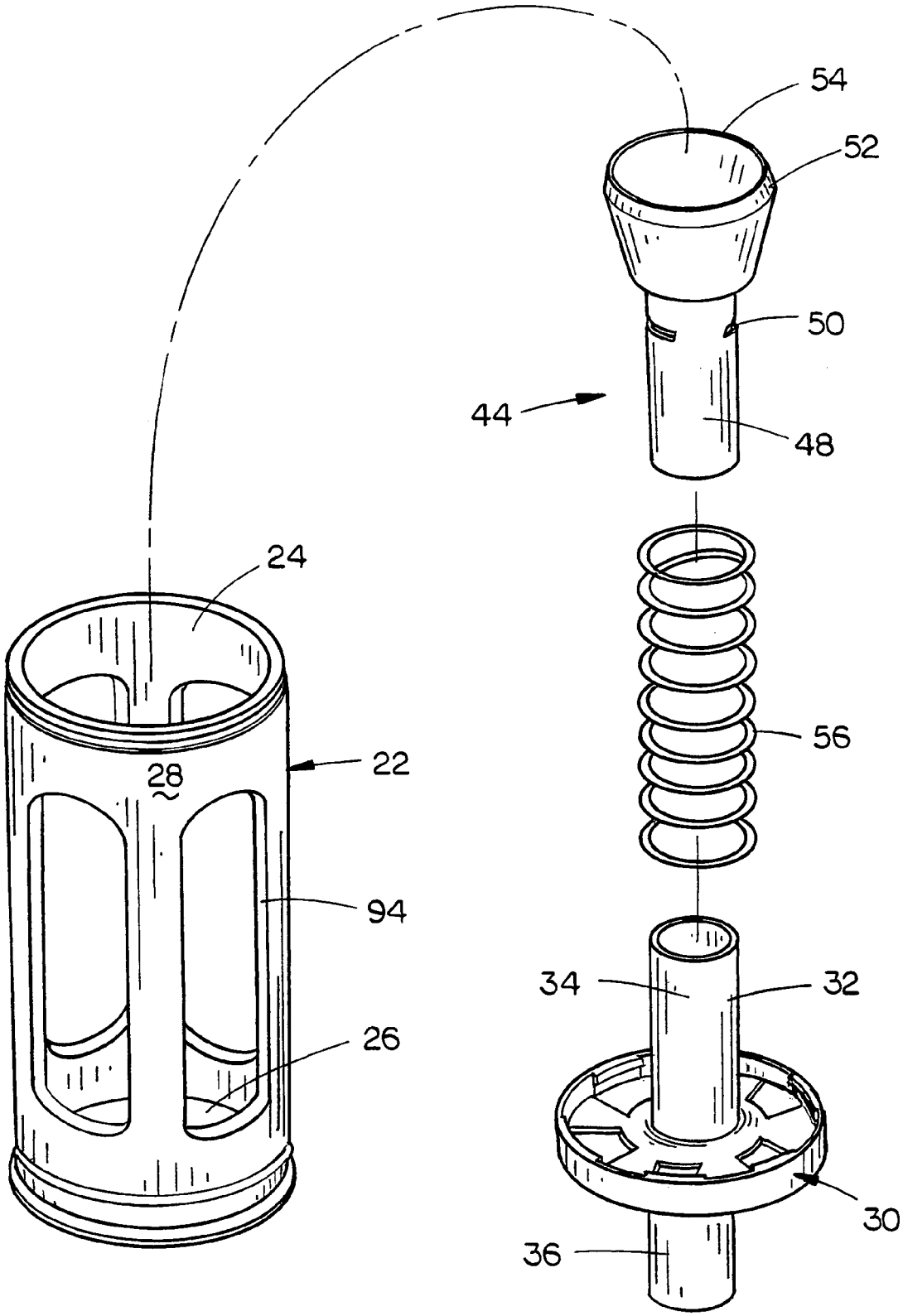
FIG. 4 is an exploded perspective view of the throat plug assembly of FIG. 2.

The numeral 16 refers to a throat plug assembly which will be described as it is positioned when the container 10 is in the inverted position. The throat plug assembly 16 is inserted into the hollow throat portion 12 of the container 10 while the container 10 is in its upright position. For purposes of description, throat plug assembly 16 will be described as including an upper end 18 and a lower end 20. The lower end 20 of the throat plug assembly 16 includes a hollow cylindrical plug member 22 having an open upper end 24, an open lower end 26, and a cylindrical wall portion 28 extending therebetween. A disk-like tube support 30 is detachably mounted on the upper end of the cylindrical wall portion 28, preferably by means of a snap-fit connection. Tube support 30 includes a tube 32 having a lower end portion 34 and an upper end portion 36. As seen in the drawings, lower end portion 34 extends downwardly from tube support 30 and upper end portion 36 extends upwardly from tube support 30. In some cases, upper end portion 36 will not be needed. In some cases, a flexible tube (not shown) will be secured to the upper end of upper tube portion 36 so as to extend upwardly into the container 10, if so required. As seen in FIG. 2, tube support 30 has a plurality of spaced-apart passageways 38 formed therein.

Figure 5:
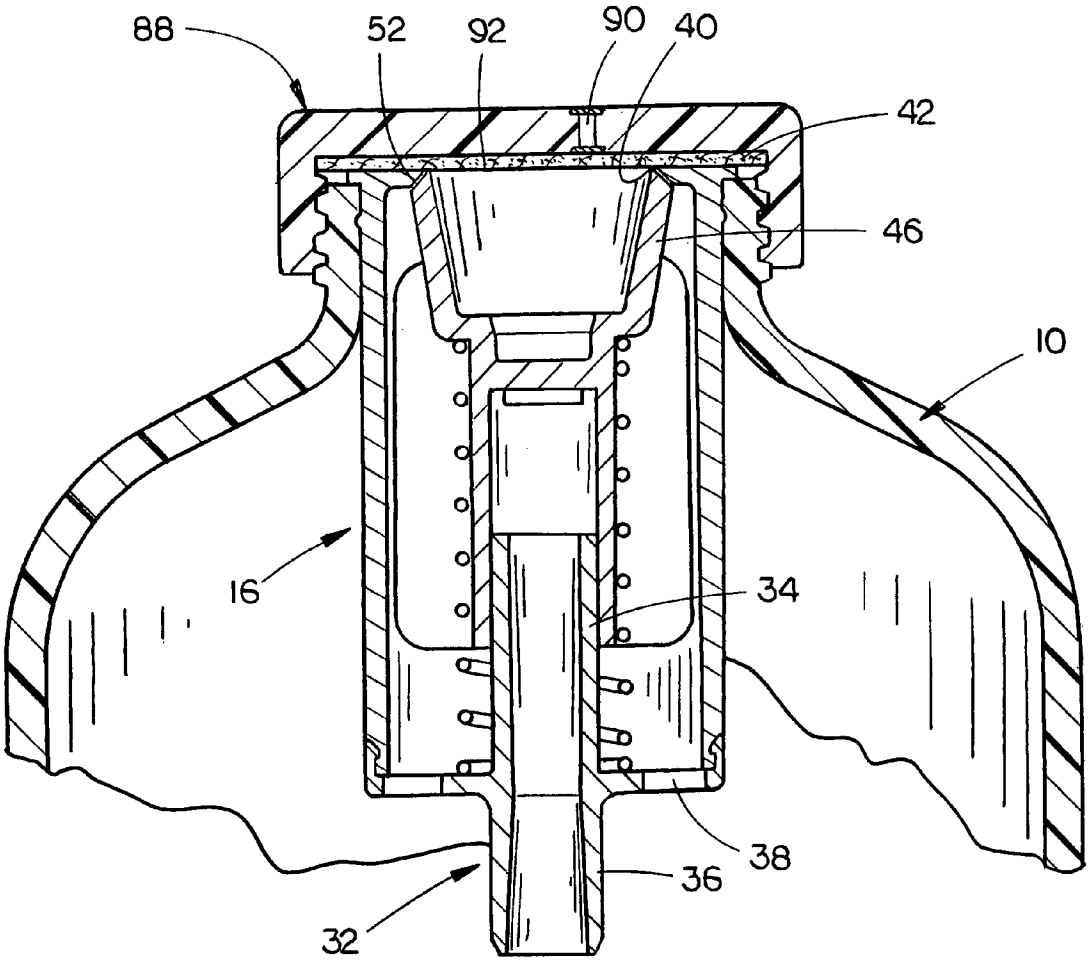
FIG. 5 is a partial vertical sectional view of the container in an upright condition illustrating the manner in which the throat plug assembly and cap permit venting of vapor pressure within the container.
Figure 6:
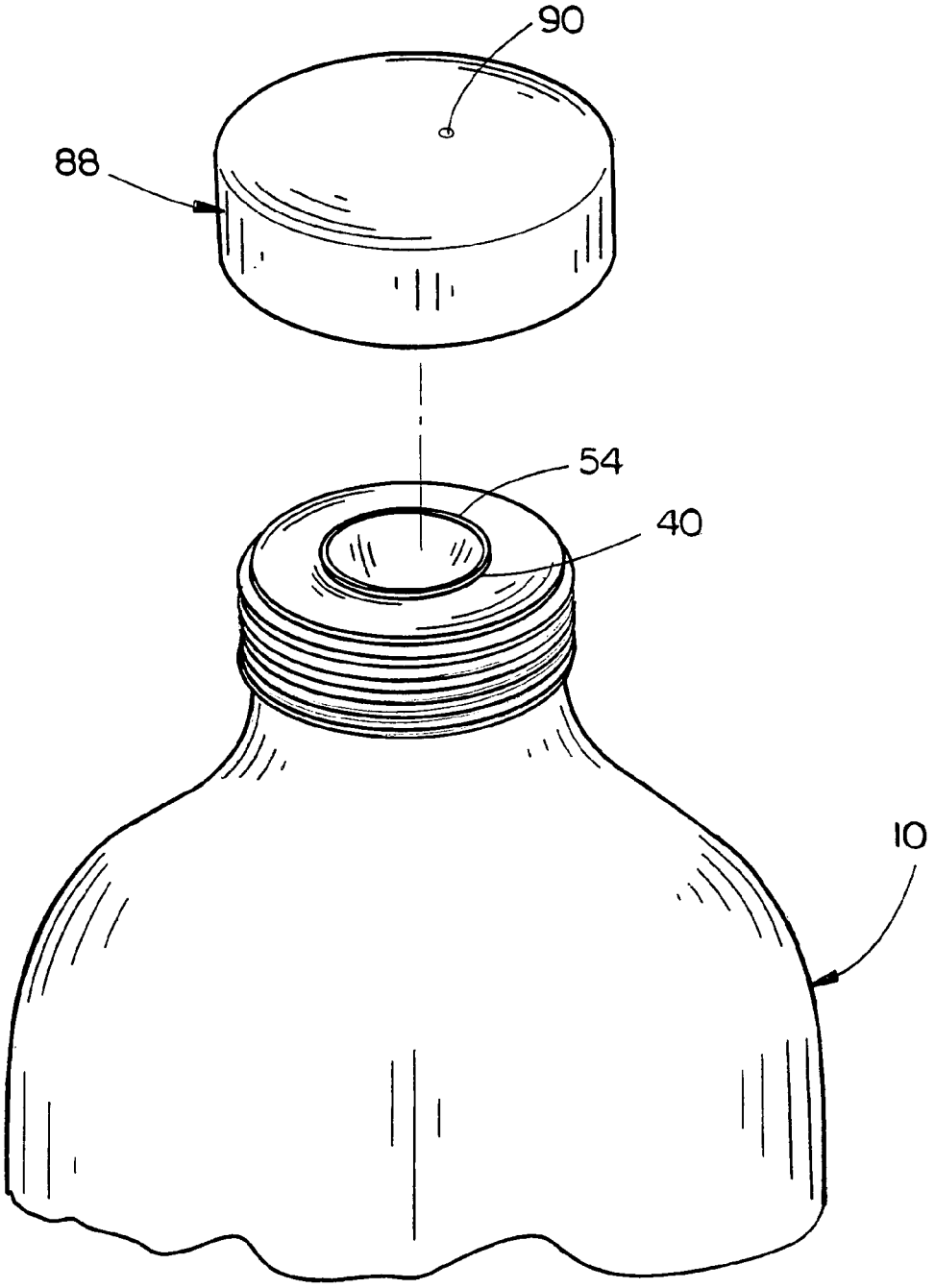
FIG. 6 is a partial exploded perspective view of the container and cap in an upright condition.

The lower end of the plug member 22 defines a centrally located opening which defines a valve seat 40. The lower end of plug member 22 also has an outwardly extending lip portion 42 which is designed to engage the upper end of the container 10, as seen in FIG. 5, to limit the downward movement of the throat plug assembly 16 with respect to container 10 when the throat plug assembly 16 is inserted downwardly into the container 10 while the container is in its upright position (FIG. 5).

Figure 9:
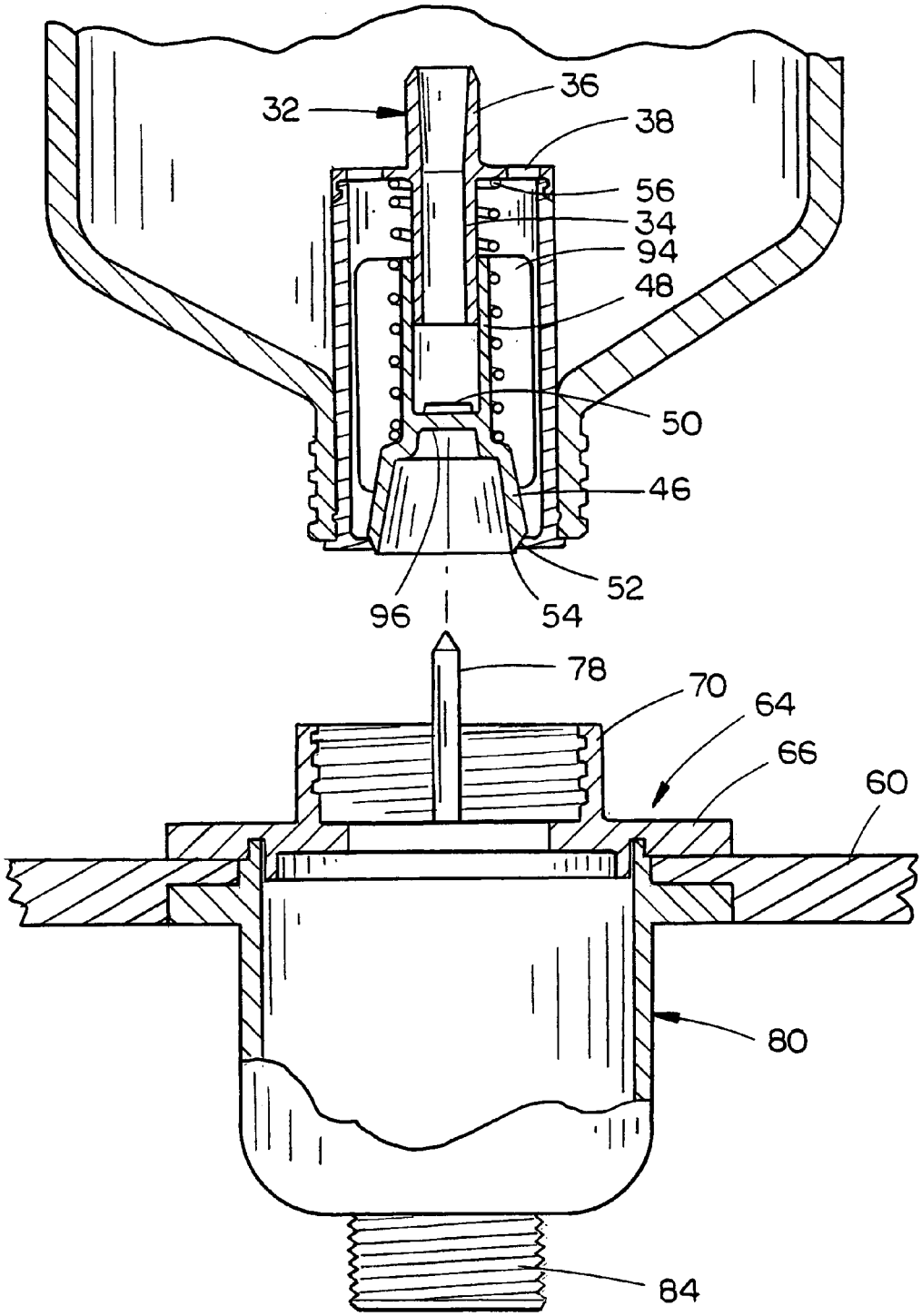
FIG. 9 is a vertical sectional view of the apparatus of FIG. 8.
Figure 10:
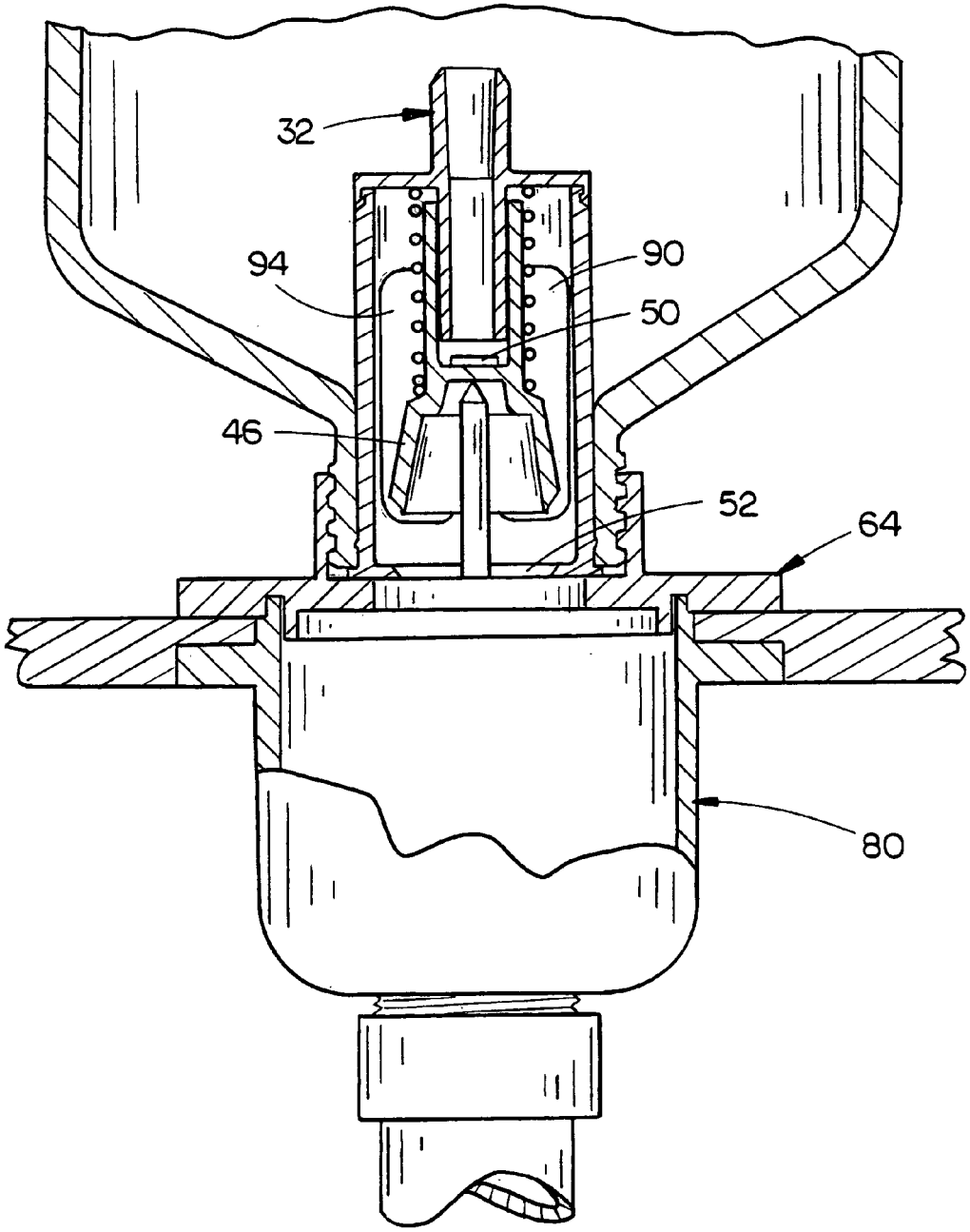
FIG. 10 is a view similar to FIG. 9 except that the container has been mounted on the receptacle at the dispensing location.

The numeral 44 refers generally to a valve means which is movably positioned within the plug member 22 and which includes a normally closed valve 46 and a hollow valve stem 48 extending upwardly therefrom. Valve stem 48 includes one or more passageways 50 extending therethrough. Valve 46 includes a tapered portion 52 at its lower end which terminates in a lower end portion 54. In those cases where the container contains liquids requiring venting during storage or shipment, the lower end portion 54 will protrude slightly downwardly from the lower end of plug member 22, as illustrated in FIG. 9. Valve stem 48 slidably receives the lower end of lower end portion 34 of tube 32, as illustrated in FIG. 9. Spring 56 embraces valve stem 48 and lower end portion 34 to yieldably urge valve 46 to its lower closed position.

Figure 7:
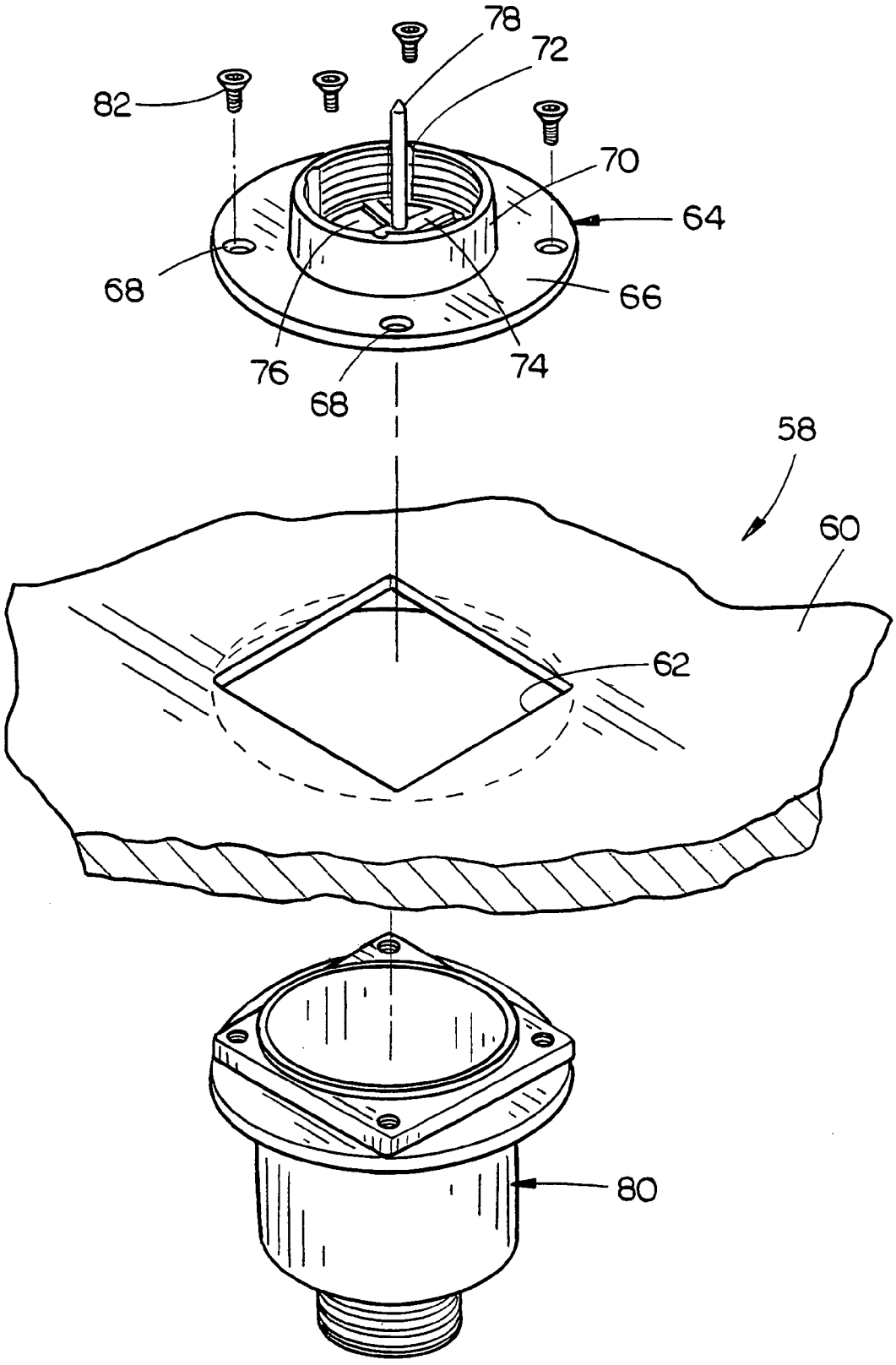
FIG. 7 is an exploded perspective view of one means of mounting the inverted container at a dispensing location.
Figure 8:
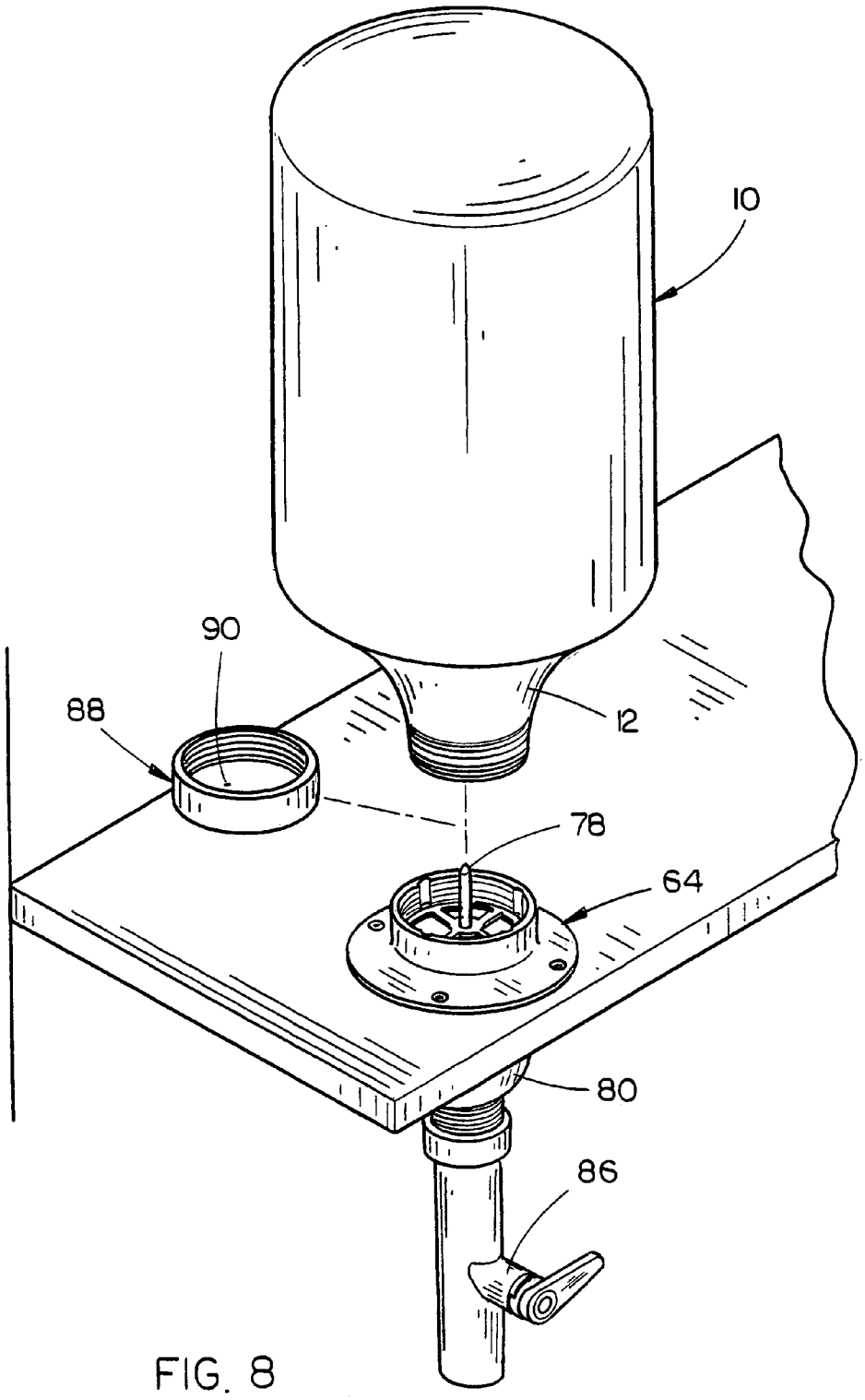
FIG. 8 is an exploded perspective view illustrating an inverted container and its relationship to the structure of FIG. 7.

FIGS. 7–9 illustrate portions of a dispensing station which is referred to generally by the reference numeral 58. Dispensing station 58 may be located within a cabinet or simply upon a horizontally disposed board or shelf 60 having an opening 62 formed therein. Included at the dispensing station 58 is a upper fixture 64 which includes a flange 66 having screw or bolt openings 68 formed therein. The fixture 64 includes an upwardly extending internally threaded stub 70. The interior of pipe stub 70 is provided with a plurality of longitudinally extending grooves or passageways formed therein. At the lower inner end of stub 70 are a plurality of support arms 74 which extend across the opening 76 and which have an actuator rod 78 secured thereto and extending upwardly therefrom.

A lower fixture 80 is positioned below the shelf and within the shelf 60, as illustrated in FIGS. 7 and 9. Screws 82 secure the fixtures 64 and 80 together, as seen in FIG. 7. Preferably, the lower end of fixture 80 includes an externally threaded throat portion 84 for dispensing liquid therethrough to a on-off valve 86 or other dispensing or metering device.

When the container 10 is being used to store, transport or dispense liquids which require venting during the shipment or storage thereof, the container 10 will include a vented cap 88 having a vent opening 90 formed therein, the lower end of which is closed by a membrane 92 which permits air to pass therethrough but does not pass liquid to pass therethrough. When the cap 88 is screwed onto the container 10, the membrane 92 will engage the end 54 of valve 46 to slightly open valve 46, as illustrated in FIG. 5, to permit air to be vented from the bottle while preventing liquid from being discharged from the bottle. When valve 46 has been slightly unseated, as illustrated in FIG. 5, vapor pressure within the container 10 may pass through the passageways or openings 94 formed in cylindrical wall member 28 and thence through the opening between the tapered surface 52 of valve 46 and the valve seat 52 and thence through the membrane 92 outwardly through the opening 90. When the throat plug assembly of this invention is not going to be used in situations where it is necessary to vent vapor pressure from the container during shipment or storage, there is no need for the end portion 54 of tapered portion 52 to be included. In that situation, the valve 46 will positively close the valve seat 40. Regardless of whether the end portion 54 is utilized or not, when the cap 88 is removed from the container 10, the valve 46 will close the valve seat 52. The container 10 is then inverted with the external threads 14 of the container 10 being threadably engaged with the internal threads on the stub 70. As the container 10 is threadably mounted into the fixture 64, the actuator rod 78 engages the valve means 44 at 96 which will cause the valve 46 to unseat from the valve seat 52. Although the fixture 64 is shown as including internal threads to effect the connection between the container and the fixture, a push-pull connection could also be utilized. Such a connection is commonly referred to as a snap-in connection.

When it is desired to dispense the liquid from the container 10 into a receptacle, tub, container, etc., the valve 86 is opened to permit liquid to flow through the passageways 94, passageways 50, and through the valve seat 52, through the fixture 64, through fixture 80, and outwardly through the valve 86. Air is permitted to enter the interior of the container 10 to prevent air locks therein during the dispensing of liquids by permitting ambient air to pass downwardly through the passageways 72 in stub 70, thence through passageways 94, passageways 50, and upwardly through the passageway 36 and also through the tube 32 into the interior of the container. Although it is preferred that all of the passageways 50, 94 and 38 be utilized, in some situations it may be only necessary to use the passageways 38 or it may only be necessary to utilize the passageways 94 or it may be only necessary to utilize the passageways 50. If the liquid is very viscous, it may be advantageous to insert a flexible tube onto the upper end of upper end portion 36 so that air passing through the tube 32 will be able to pass through the viscous liquid to the upper end of the container.

Thus the dispensing system of this invention may be utilized to vent containers or it may be used where venting is not required. The system of this invention is extremely economical and provides for a continuous gravity flow due to the fact that ambient air can enter the interior of the container to replace the liquid being dispensed therefrom. The dispensing system of this invention eliminates any possibility of a vapor lock and provides a positive shut-off.

Thus it can be seen that the invention accomplishes at least all of its stated objectives.

I claim:

1. In combination, an inverted liquid container having upper and lower ends;

said lower end of said container having a hollow throat extending downwardly therefrom which has interior and exterior surfaces;

a throat plug assembly having upper and lower ends, positioned in said throat of said container;

said throat plug assembly including a hollow cylindrical plug member having an open upper end, an open lower end, and a cylindrical wall portion extending therebetween;

a tube support positioned on said open upper end of said plug member;

a hollow tube, having upper and lower ends, secured to said tube support so that its said lower end is positioned below said tube support within said plug member;

said open lower end of said plug member defining a valve seat;

a valve means movably positioned within said plug member and including a normally closed valve and a hollow valve stem extending upwardly therefrom;

said hollow valve stem being slidably mounted on said hollow tube;

said valve being movable between open and closed positions;

said valve, when in its said closed position, seating upon said valve seat to close said open lower end of said plug member;

a spring in said plug member which is in engagement with said valve means to yieldably urge said valve to its said closed position;

said valve, when in its said closed position, preventing liquid within the container from flowing therefrom;

said valve, when in its open position, permitting liquid within the container to flow therethrough;

at least one of said tube support, said cylindrical wall portion or said valve stem having a passageway formed therein;

said throat plug assembly, when said valve is in its said open position, permitting liquid in said container to flow therefrom through said passageway, around said valve and outwardly through said valve seat;

said throat plug assembly, when said valve is in its said open position, permitting air to enter said container by passing through said valve seat, around said valve and through said passageway.

2. The combination of claim 1 wherein said passageway is formed in said cylindrical wall portion.

3. The combination of claim 2 wherein a plurality of spaced-apart passageways is formed in said cylindrical wall portion.

4. The combination of claim 1 wherein said passageway is formed in said valve stem.

5. The combination of claim 1 wherein said passageway is formed in said tube support.

6. The combination of claim 1 wherein said passageway is formed in said cylindrical wall portion and said valve stem.

7. The combination of claim 1 wherein said passageway is formed in said cylindrical wall portion.

8. The combination of claim 1 wherein said passageway is formed in said tube support and said valve stem.

9. The combination of claim 1 wherein said passageway is formed in said valve stem and said cylindrical wall portion.

10. The combination of claim 1 wherein a plurality of passageways are formed in said cylindrical wall portion and said tube support.

11. The combination of claim 1 wherein said tube has its said upper end positioned above said tube support.

12. The combination of claim 1 wherein said valve includes an end portion which protrudes through said valve seat for engagement by a closure cap mounted on the container which will slightly open said valve to permit vapor pressure to be vented from the container during shipment and/or storage.

13. In combination, a dispensing fixture;

an inverted liquid container having upper and lower ends;

said lower end of said container having a hollow throat extending downwardly therefrom which has interior and exterior surfaces;

said throat of said container being detachably connected to said dispensing fixture;

a throat plug assembly having upper and lower ends, positioned in said throat of said container;

said throat plug assembly including a hollow cylindrical plug member having an open upper end, an open lower end, and a cylindrical wall portion extending therebetween;

a tube support positioned on said open upper end of said plug member;

a hollow tube, having upper and lower ends, secured to said tube support so that its said lower end is positioned below said tube support within said plug member;

said open lower end of said plug member defining a valve seat;

a valve means movably positioned within said plug member and including a normally closed valve and a hollow valve stem extending upwardly therefrom;

said hollow valve stem being slidably mounted on said hollow tube;

said valve being movable between open and closed positions;

said valve, when in its said closed position, seating upon said valve seat to close said open lower end of said plug member;

a spring in said plug member which is in engagement with said valve means to yieldably urge said valve to its said closed position;

said valve, when in its said closed position, preventing liquid within the container from flowing therefrom;

said valve, when in its open position, permitting liquid within the container to flow therethrough;

at least one of said tube support, said cylindrical wall portion or said valve stem having a passageway formed therein;

said throat plug assembly, when said valve is in its said open position, permitting liquid in said container to flow therefrom through said passageway, around said valve and outwardly through said valve seat;

said throat plug assembly, when said valve is in its said open position, permitting air to enter said container by passing through said valve seat, around said valve and through said passageway;

said dispensing fixture engaging said valve to move said valve to its said open position when said container is attached to said dispensing fixture.

14. The combination of claim 13 wherein said passageway is formed in said cylindrical wall portion.

15. The combination of claim 14 wherein a plurality of spaced-apart passageways is formed in said cylindrical wall portion.

16. The combination of claim 13 wherein said passageway is formed in said valve stem.

17. The combination of claim 13 wherein said passageway is formed in said tube support.

18. The combination of claim 13 wherein said passageway is formed in said cylindrical wall portion and said valve stem.

19. The combination of claim 13 wherein said passageway is formed in said cylindrical wall portion.

20. The combination of claim 13 wherein said passageway is formed in said tube support and said valve stem.

21. The combination of claim 13 wherein said passageway is formed in said valve stem and said cylindrical wall portion.

22. The combination of claim 13 wherein a plurality of passageways are formed in said cylindrical wall portion and said tube support.

23. The combination of claim 13 wherein said tube has its said upper end positioned above said tube support.

* * * * *